US009175561B2

(12) United States Patent
Brown

(10) Patent No.: US 9,175,561 B2
(45) Date of Patent: Nov. 3, 2015

(54) RESIN INJECTION APPARATUS FOR DRILLING APPARATUS FOR INSTALLING A GROUND ANCHOR

(76) Inventor: Shane Brown, Bayswater (AU)

( * ) Notice: Subject to any disclaimer, the term of this patent is extended or adjusted under 35 U.S.C. 154(b) by 49 days.

(21) Appl. No.: 14/126,266

(22) PCT Filed: Jun. 12, 2012

(86) PCT No.: PCT/AU2012/000670

§ 371 (c)(1),
(2), (4) Date: Dec. 13, 2013

(87) PCT Pub. No.: WO2012/171056

PCT Pub. Date: Dec. 20, 2012

(65) Prior Publication Data

US 2014/0140773 A1 May 22, 2014

(30) Foreign Application Priority Data

Jun. 14, 2011 (AU) ..... 2011902323

(51) Int. Cl.
*E21D 20/00* (2006.01)
*E21D 20/02* (2006.01)

(52) U.S. Cl.
CPC ..... *E21D 20/028* (2013.01); *E21D 20/003* (2013.01)

(58) Field of Classification Search
USPC ..... 405/259.1, 259.5, 259.6, 302.1, 302.4
See application file for complete search history.

(56) References Cited

U.S. PATENT DOCUMENTS

| | | | | |
|---|---|---|---|---|
| 4,643,619 | A * | 2/1987 | Issakainen | 405/303 |
| 4,979,848 | A | 12/1990 | Sauer | |
| 6,033,153 | A | 3/2000 | Fergusson | |
| 6,857,486 | B2 * | 2/2005 | Chitwood et al. | 175/104 |
| 7,287,608 | B2 | 10/2007 | Mocivnik et al. | |
| 2007/0286687 | A1 | 12/2007 | Melegari | |
| 2011/0070035 | A1 * | 3/2011 | Ricardo | 405/259.5 |

FOREIGN PATENT DOCUMENTS

| | | |
|---|---|---|
| AU | 2005201548 | 5/2005 |
| GB | 2 263 958 | 8/1993 |
| JP | 2012/077509 | 4/2012 |
| WO | 00/60215 | 10/2000 |
| WO | 2007/023363 | 3/2007 |
| WO | 2007/059580 | 5/2007 |
| WO | 2009/079684 | 7/2009 |
| WO | 2010/031132 | 3/2010 |

* cited by examiner

*Primary Examiner* — Sean Andrish
(74) *Attorney, Agent, or Firm* — Hamre, Schumann, Mueller & Larson, P.C.

(57) ABSTRACT

A resin injection apparatus 19 for use in connection with a drilling apparatus 10 for installing ground anchors. The resin injection apparatus 19 comprises a resin injector adaptor 20, adapted to be connected in fluid communication with a hollow drill shaft 21 of a drill rig 10. The resin injector adaptor 20 can be used to inject one or more resin fluids into the drill shaft 21 wherein, in use, when a hole has been drilled in a rock stratum, resin can be injected into the hole via the drill shaft prior to inserting a ground anchor.

12 Claims, 9 Drawing Sheets

1|9

RESIN INJECTION APPARATUS FOR DRILLING APPARATUS FOR INSTALLING A GROUND ANCHOR

FIELD OF THE INVENTION

The present invention relates to a method and apparatus for injecting resin into a rock formation. In particular, the invention relates to a resin injection apparatus and method for injecting resin during the installation of ground anchors in ground/rock strata.

BACKGROUND TO THE INVENTION

In most underground mines, ground anchors form the basis of the primary roof and/or wall support systems within tunnels. To enforce a roof or wall, ground anchors can be installed mechanically or manually using resin, cement grout, friction anchors or point anchors or a combination of such. It has been estimated that 30%-35% of the rock anchors do not perform to specification and may represent some risk to the maintenance of a safe workplace environment (Galvin et al 2001).

Typically the method for installing chemical anchors, otherwise known as resin anchors, first requires for a hole to be drilled into the roof or wall. Resin anchors comprise steel bolts/cables which when in position are encased in a resin within the drill hole. The resin protects the bolt from the corrosive influences within the drill hole and penetrates the surrounding rock formation to adhesively unite the strata and hold the steel bolt in position.

The resin is typically supplied in a cylindrical two component cartridge which comprises a resin component and a resin catalyst component. In use the cartridge is manually inserted into a drilled hole and the steel bolt/cable is then inserted into the hole. The insertion of the bolt causes the plastic sheath of the cartridge to break. The steel bolt is then rotated to shred the cartridge, mix the resin components and disperse the resin. The resin mixture fills the annular area between the drill hole wall and the shaft of the steel bolt. The mixed resin cures and binds the steel bolt to the surrounding rock strata.

Breaking the plastic sheath of the cartridge and mixing the resin components effectively can be problematic. Many resin anchors are ineffective because the resin components are not mixed completely. The shredded cartridge can interfere with the resin and catalyst mixing. Poor mixing results in an inferior cured resin and results in poor bond strength between the bolt and drill hole wall. Furthermore this method of installing resin anchors is complicated and time-consuming. The method requires a mineworker to be positioned in the non-supported portion of tunnel for the manual insertion of the resin cartridge. The method results in slow resin anchor installation and provides for workplace safety issues.

A single-stage self-drilling resin anchor system has been proposed as a solution to overcome the aforementioned limitations. This system utilises a hollow bar with a passage through the centre of the bar serving as a flowpath for water. A cavity is provided at the centre of the bar for housing the resin cartridge. In this system, after the drill hole has been completed, water is injected into the cavity containing the resin cartridge. The water ruptures the resin cartridge, forcing resin through a hole in the tip of the bar into the drill hole with the steel bolt. The resin then sets, bonding the bolt to the rock strata.

A disadvantage with this system is that the resin cartridge may prematurely rupture during transportation, or during the boring process, prior to completion of the boring process. A further problem is that there may not be sufficient resin forced into the hole for securing the steel bolt.

A dedicated drill rig has also been proposed. This system has a dedicated drill and installation platform where the hole is drilled, a resin injector guide tube is indexed over to the drilled hole and the resin is fired into the drilled hole. Once the resin is fired into the hole then the ground anchor is indexed across and installed into the drilled hole. Throughout this process, the drill component is stationary. This rig provides a very good process for ground support installation. However, because it is a dedicated machine it is very expensive for a mining business to incorporate into their fleet as it cannot perform any other function apart from ground support installation. Further, the resin cartridge can break open causing the two chemicals to mix and form into a solid mass, and thereby blocking off the hole and stopping the ground anchor from entering the drilled hole.

From the above description of several prior art methods of installing ground anchors it can be seen that the prior art systems utilised suffer from issues associated with at least resin stability and effective mixing of resin components once in use. Various safety issues also arise. Therefore, the present invention was developed with a view to providing a simple and effective method and apparatus for injecting resin for use during the installation of resin anchors.

References to prior art in this specification are provided for illustrative purposes only and are not to be taken as an admission that such prior art is part of the common general knowledge in Australia or elsewhere.

SUMMARY OF THE INVENTION

According to one aspect of the present invention there is provided a resin injection apparatus for use in connection with a drilling apparatus for installing ground anchors, the injection apparatus comprising:

a fluid injector, adapted to be connected in fluid communication with a hollow drill shaft of the drilling apparatus, for injecting one or more resin fluids into the drill shaft wherein, in use, when a hole has been drilled in a ground/rock strata, resin can be injected into the hole via the drill shaft prior to inserting a ground anchor.

Preferably the fluid injector comprises a rotatable engaging means for rotatably connecting the fluid injector to the drill shaft wherein, in use, the fluid injector remains stationary while the drill shaft rotates. Advantageously the rotatable engaging means comprises first and second sealed bearings which provide a fluid-tight seal between an outer surface of the drill shaft and an interior of the rotatable engaging means.

Preferably the rotatable engaging means further comprises an outer housing enclosing a mixing chamber within the interior of the rotatable engaging means. Advantageously the mixing chamber is in fluid communication with a fluid injection port provided in the wall of the drill shaft in a region enclosed by the mixing chamber within the rotatable engaging means of the fluid injector.

Typically the rotatable engaging means is releasably connected to the drill shaft. Preferably the fluid injector further comprising a locking means releasably attached to an outer housing of the fluid injector and releasably attached to the drilling apparatus.

Preferably the fluid injector has a plurality of fluid inlet ports for injecting different fluid components of the resin into the drill shaft. Advantageously the plurality of fluid inlet ports is provided in a valve manifold. Preferably the fluid inlet ports are each provided with a valve to inhibit the cross contamination of the resin fluid components. In one embodiment the valves provided in the valve manifold are shuttle valves. Preferably at least one additional inlet port is provided to receive a flushing medium for flushing the fluid injector and drill shaft of the resin fluid components after use.

Preferably the resin injection apparatus further comprises a fluid pumping system for pumping the resin fluid components to the fluid injector. Typically the pumping system comprises a plurality of fluid containers and a separate pump for each container for pumping the fluids from the respective containers to a corresponding fluid inlet port on the fluid injector. Preferably the pumps are fixed displacement pumps. Advantageously the fluid pumping system is mounted on a support frame which can be retro-fitted to any type of drilling apparatus.

Advantageously the pumps may operate to provide different flow rates of resin fluid components to the fluid injector.

Preferably the resin injection apparatus further comprises an electronic control system for controlling the operation of the fluid injector and fluid pumping system.

According to another aspect of the present invention there is provided a method of injecting resin for use in connection with a drilling apparatus for installing ground anchors, the method comprising the steps of:

providing a fluid injector adapted to be connected in fluid communication with a hollow drill shaft of the drilling apparatus;

injecting one or more resin fluids via the fluid injector into the hollow drill shaft of the drilling apparatus after drilling such that the one or more resin fluids is transferred to a hole drilled in a rock strata.

Preferably the step of injecting involves pumping a first chemical resin fluid and a second chemical resin fluid separately to the fluid injector, and simultaneously injecting the first and second chemical fluids into the hollow drill shaft.

Preferably the method further comprises the step of injecting a flushing medium into the fluid injector and the hollow drill shaft such that the flushing medium flushes the fluid injector and drill shaft of any residual chemical fluids.

Preferably the method further comprises the step of mixing the first and second chemical resin fluids in the hollow drill shaft. Preferably the step of mixing comprises inserting a ground anchor into the hole and rotating the ground anchor to facilitate further mixing.

According to a further aspect of the present invention there is provided a drilling apparatus for installing ground anchors, the drilling apparatus comprising:

a rock drill comprising a hollow drill shaft for drilling a hole in a ground/rock strata;

a fluid injector provided in fluid communication with the hollow drill shaft of the rock drill, for injecting one or more resin fluids into the drill shaft wherein, in use, when a hole has been drilled in a rock strata, resin can be injected into the hole via the drill shaft prior to inserting a ground anchor.

Preferably the drilling apparatus further comprises a fluid pumping system for transferring the resin fluid components to the fluid injector. Typically the pumping system comprises a plurality of fluid containers and a separate pump for each container for pumping the fluids from the respective containers to a corresponding fluid inlet port on the fluid injector.

Preferably the drilling apparatus is an underground drill rig.

Throughout the specification, the term "strata" refers to a mass of rock, earth and/or soil as may be found in an embankment, quarry, mine or tunnel.

Throughout the specification, the term "resin" typically refers to any casting resins or synthetic resins, which are liquid monomers of thermosetting plastics or alternatively cementious grout. However the term "resin" may refer to any chemical substance known to a person skilled in the art for use in mining, civil or industrial ground support purposes.

Throughout the specification, unless the context requires otherwise, the word "comprise" or variations such as "comprises" or "comprising", will be understood to imply the inclusion of a stated integer or group of integers but not the exclusion of any other integer or group of integers. Likewise the word "preferably" or variations such as "preferred", will be understood to imply that a stated integer or group of integers is desirable but not essential to the working of the invention.

BRIEF DESCRIPTION OF THE DRAWINGS

The nature of the invention will be better understood from the following detailed description of a specific embodiment of the method and apparatus for injecting resin, given by way of example only, with reference to the accompanying drawings, in which.

DETAILED DESCRIPTION OF PREFERRED EMBODIMENTS

Figure 1:
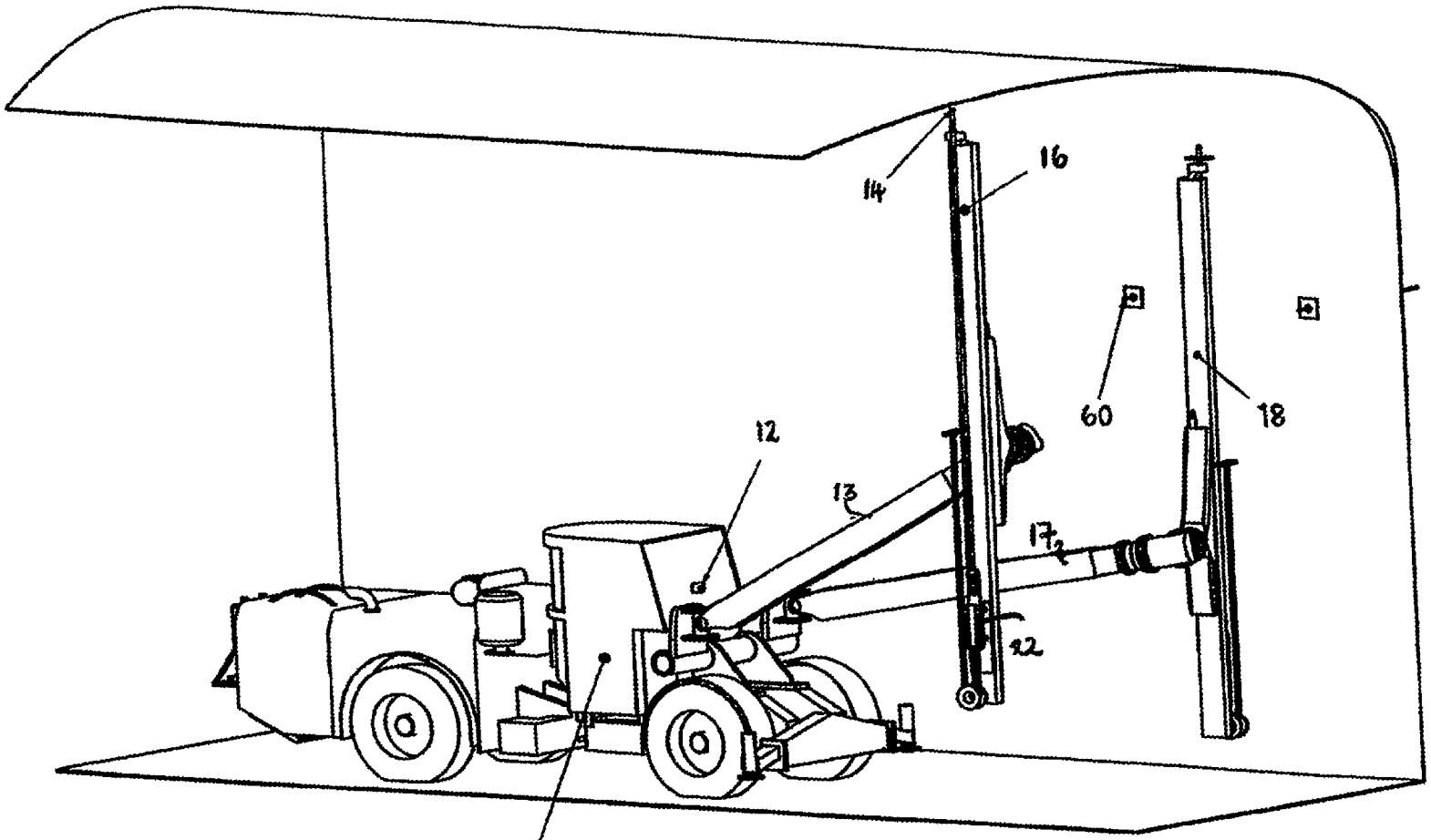
FIG. 1 illustrates a drill rig for installing ground anchors with which a preferred embodiment of the resin injection apparatus according to the present invention is used.
Figure 6A:
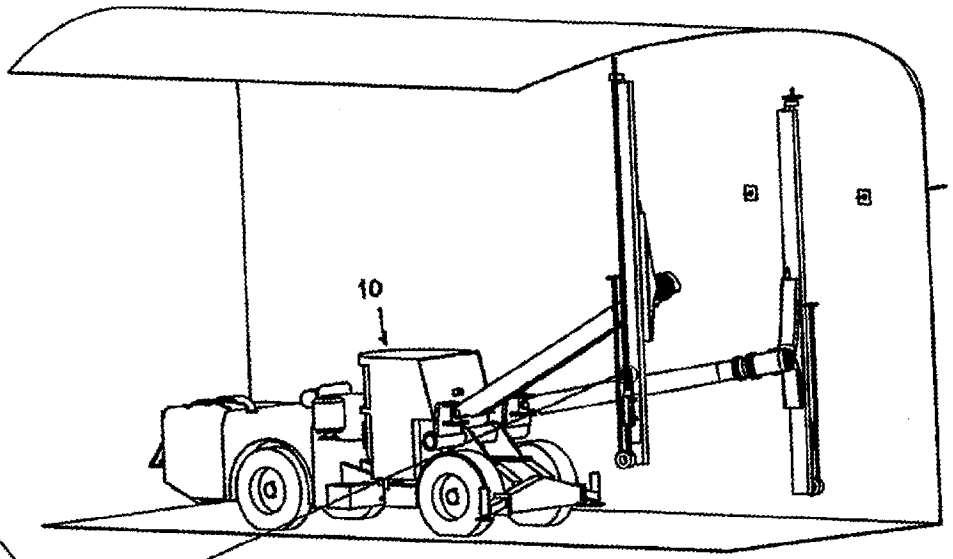
FIG. 6A shows the drill rig of FIG. 1.
Figure 6B:
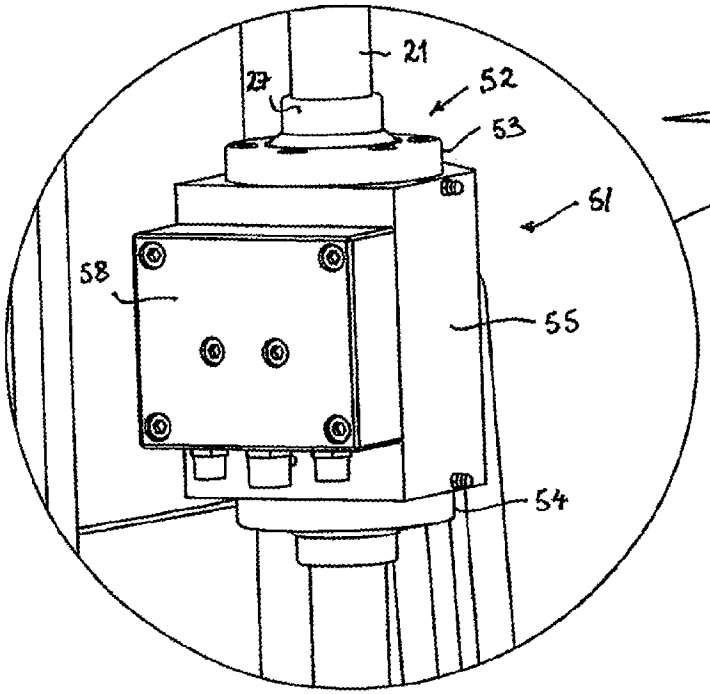
FIG. 6B includes an enlargement of part of the drill rig of FIG. 6A showing a second embodiment of a fluid injector according to the present invention.
Figure 7:
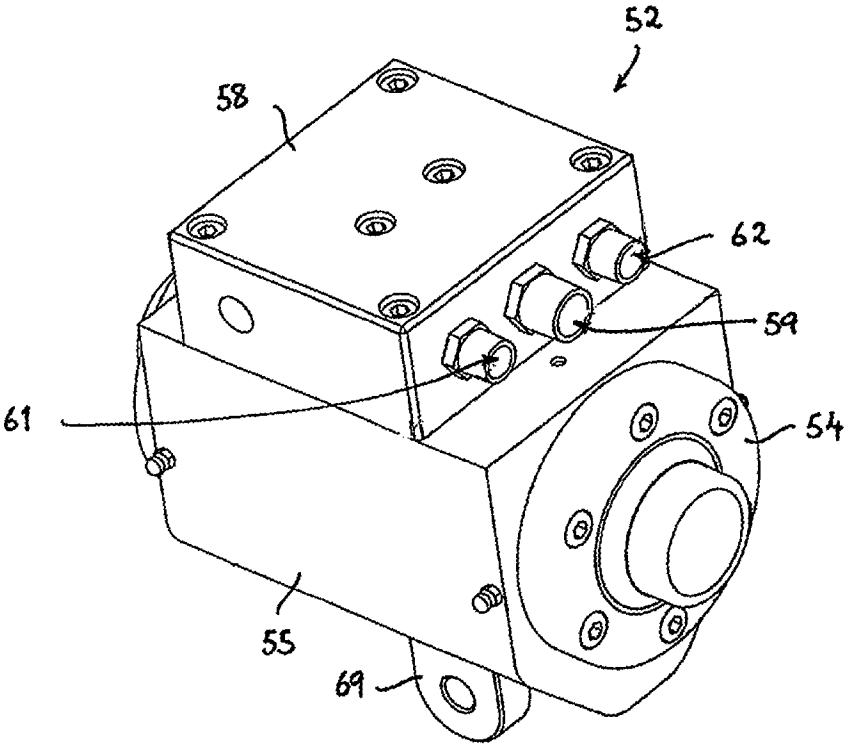
FIG. 7 is a perspective view of the fluid injector of FIG. 6B.

In FIGS. 1 and 6 there is shown drill rig 10 for use in installing a ground anchor 60. The drill rig 10 comprises two hydraulically driven, extendable and positionable arms 13, 17 each of which supports a first and second feed component 16, 18 respectively. The first and second feed components 16, 18 can each accommodate a drill/rock drill which is used to drill the holes within ground/rock strata. As illustrated in FIG. 1, the first feed component 16 comprises an elongate rock drill 22 having a drill shaft 21 and a drill bit 14 releasably attached at its distal end. The arms 13, 17 enable two holes to be drilled simultaneously in an extended portion of a mine tunnel without the main part of the drill rig 10 having to enter the extended portion. It should be noted that the main part of the drill rig 10 incorporates the cabin in which the operator is seated.

A preferred embodiment of the resin injection apparatus 19 according to the present invention, which is typically used in connection with a drilling apparatus, in this instance, the drill rig 10, will now be described in detail.

Figure 2A:
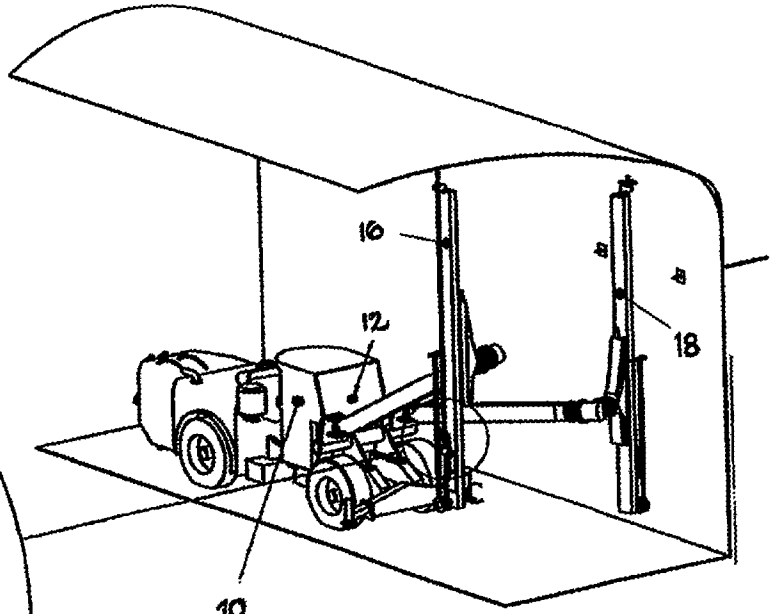
FIG. 2A shows the drill rig of FIG. 1.
Figure 2B:
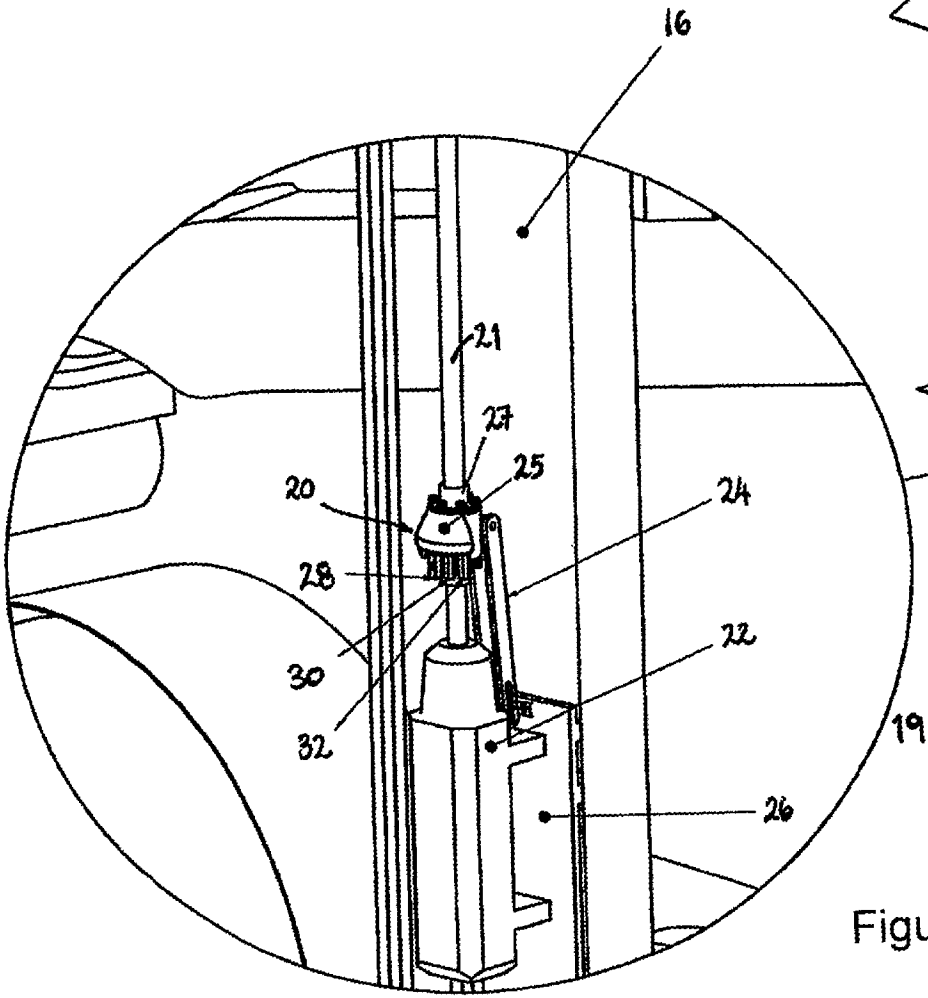
FIG. 2B is an enlargement of part of the drill rig of FIG. 2A showing a first embodiment of a fluid injector according to the present invention.
Figure 3A:
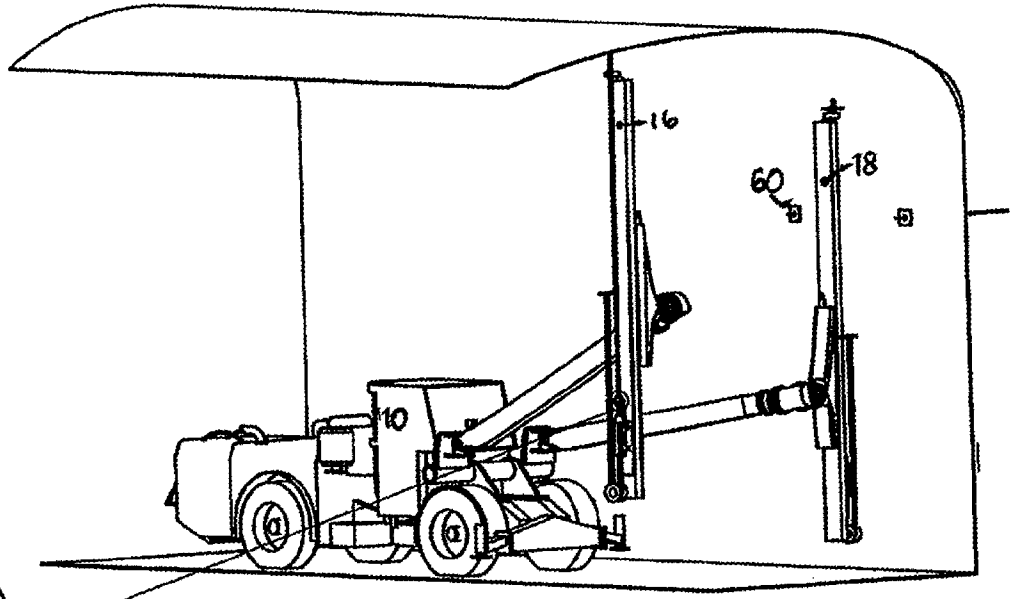
FIG. 3A shows the drill rig of FIG. 1.
Figure 3B:
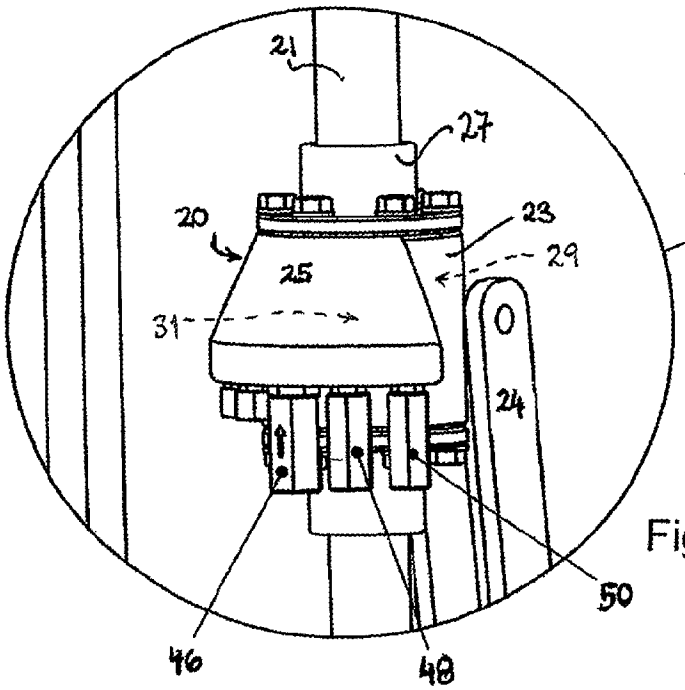
FIG. 3B is a further enlargement of the fluid injector of FIG. 2B.

The resin injection apparatus 19 comprises a fluid injector in the form of resin injection adaptor 20, as can be seen most clearly in FIG. 2 and FIG. 3. The resin injection adaptor 20 is adapted to be connected in fluid communication with the drill shaft 21 of the rock drill 22. The injection adaptor 20 injects one or more resin fluids into the drill shaft 21 wherein, in use, when a hole has been drilled in a ground/rock strata, resin can be injected into the hole via the drill shaft 21 prior to inserting a ground anchor 60.

Preferably the injection adaptor 20 comprises a rotatable engaging means 23 for rotatably engaging the drill shaft 21. The rotatable engaging means has an outer housing 25 and a locking bar 24 releasably attached to the outer housing 25 (see FIG. 3). In use, the outer housing 25 of the injection adaptor remains stationary while the drill shaft 21 rotates. Advantageously the rotatable engaging means 23 is releasably connected to the drill shaft 21 via coupling 27. The locking bar 24 is likewise releasably attached to a locking plate 26 on the rock drill 22. Advantageously, the locking bar 24 substantially prevents the outer housing 25 of the resin injection adaptor 20 from rotating when the rock drill 22 is in use throughout the drilling and resin anchor installation process.

The resin injection adaptor 20 has a plurality of fluid inlet ports 28, 30 and 32, for injecting different fluid components of the resin into the drill shaft 21. The fluid inlet ports are each provided with a check valve 46, 48 and 50 respectively, to inhibit the cross-contamination of the resin fluid components. Fluid entering resin injection adaptor 20 via the check valves flows into a mixing chamber 31 (not visible) housed within the outer housing 25. A fluid injection port 29 (not visible) is provided in a portion of the coupling 27 which is enclosed by the rotatable engaging means 23, and is in fluid communication with the mixing chamber 31.

Preferably a first one of the fluid inlet ports 28 is adapted to receive a flushing medium for flushing the resin injection adaptor 20 and drill shaft 21 of the resin fluid components after use. Preferably, the second fluid inlet port 30 is provided for receiving a first chemical resin fluid and the third fluid inlet port 32 is provided for receiving a second chemical resin fluid, for example a resin and a resin catalyst, respectively. Preferably, hoses (not shown) extend to the respective check valves 46, 48 and 50. The resin injection adaptor 20 can be installed on any multi feed/boom configured drill rig or dedicated bolting drill.

Figure 4A:
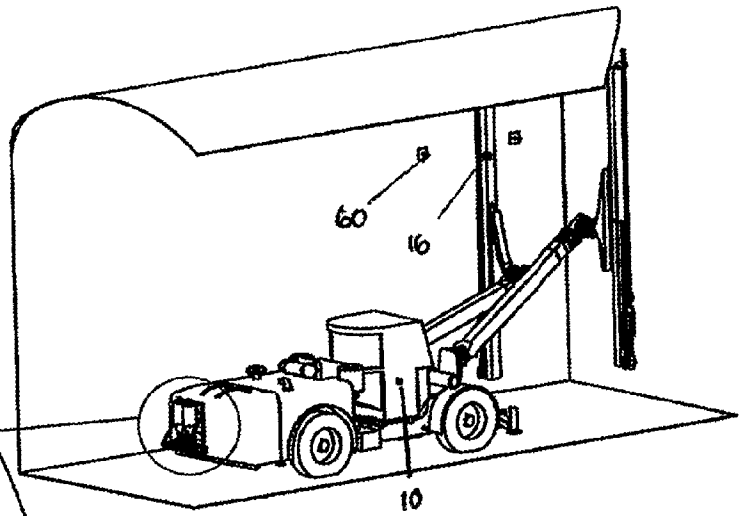
FIG. 4A shows the drill rig of FIG. 1.
Figure 4B:
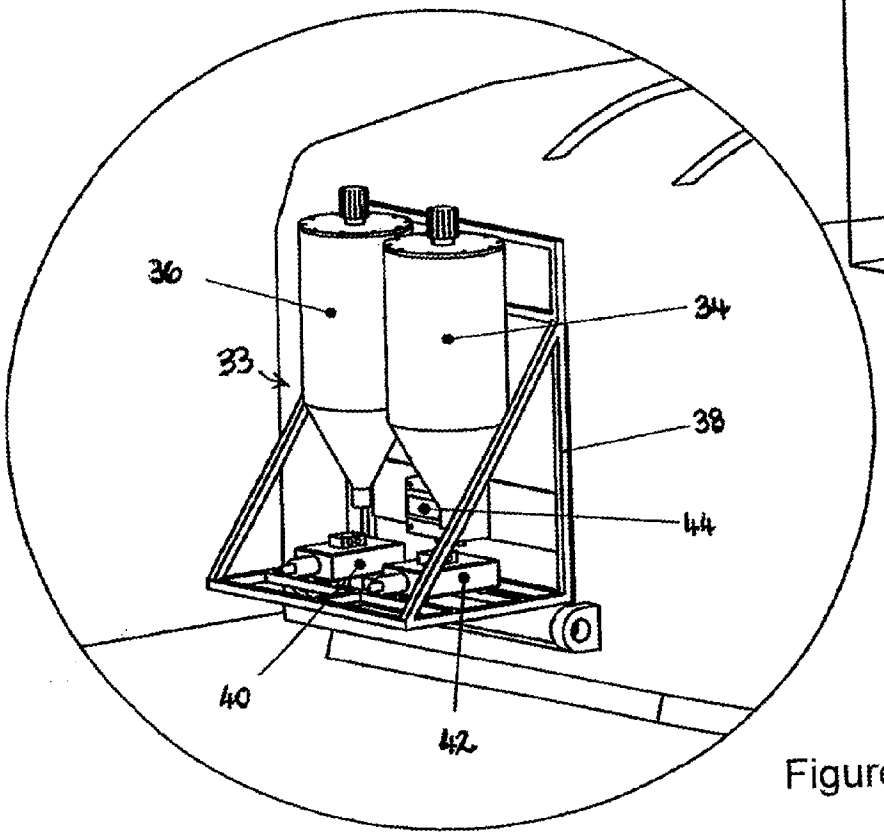
FIG. 4B is an enlargement of a preferred embodiment of a pumping system used in connection with the resin injection apparatus according to the present invention.

Preferably the resin injection apparatus 19 further comprises a fluid pumping system 33, as illustrated in FIG. 4, for transferring the resin fluid components to the resin injection adaptor 20. Typically the pumping system 33 comprises a plurality of fluid containers 34, 36 and a separate pump 40, 42 for each container for pumping the chemical resin fluids from the respective containers to a corresponding fluid inlet port on the resin injection adaptor 20. Preferably the pumps 40, 42 are fixed displacement pumps. Advantageously the fluid pumping system is mounted on a support frame 38 which can be retro-fitted to any type of drilling apparatus.

Figure 5:
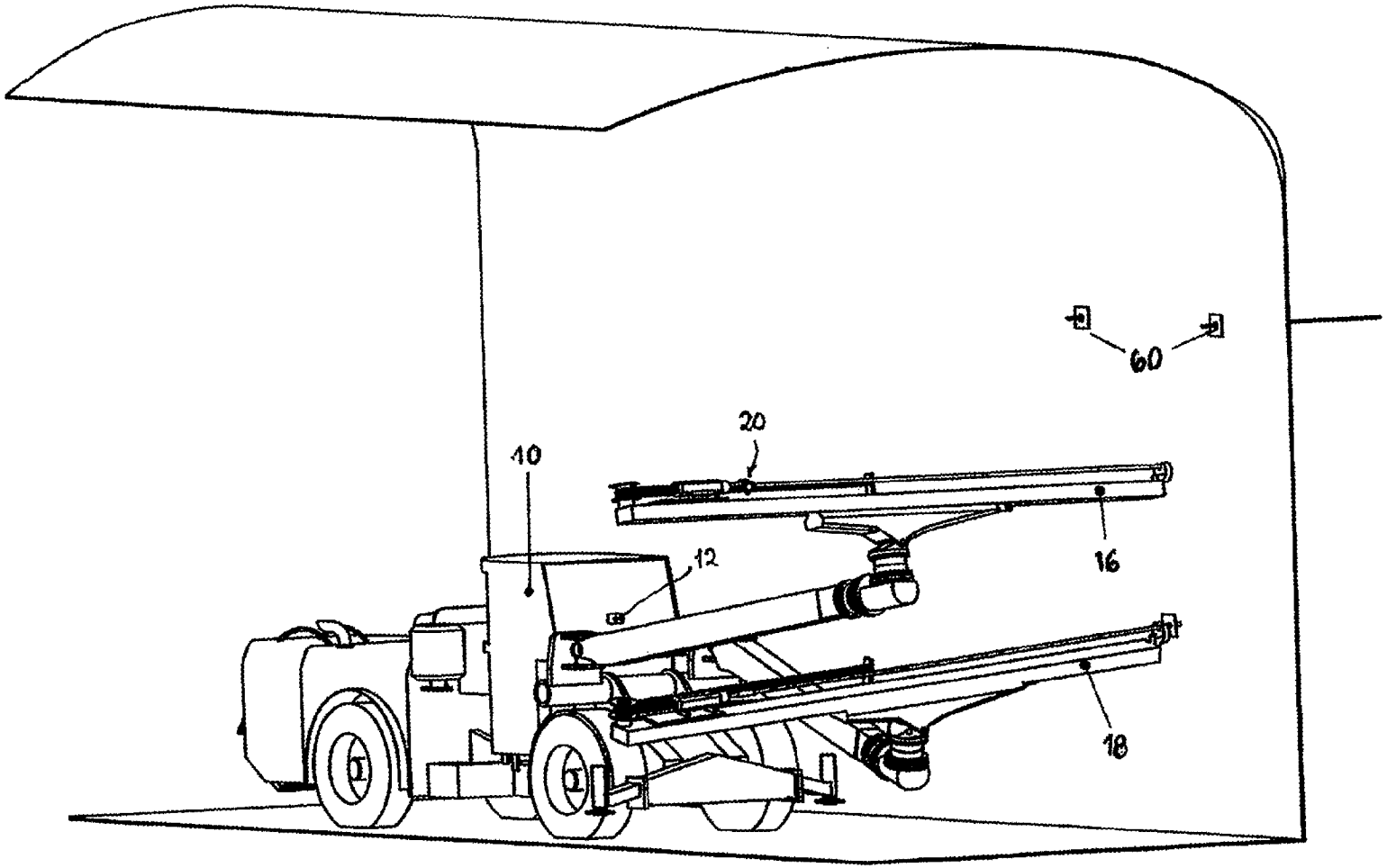
FIG. 5 is a further view of the drill rig of FIG. 1.

The resin injection apparatus 19 further comprises an electronic control system 44 for controlling the operation of the resin injection adaptor 20, extraction speed and fluid pumping system 33. The electronic control system 44 is preferably housed on the support frame 38 of the pumping system 33 as depicted in FIG. 4. It is envisaged that the control system 44 can be manually started or alternatively automatically started following the activation of a start button 12, as shown in FIGS. 1 and 5, in the cabin of the drill rig 10.

In use, the pumps 40 and 42 deliver the first and second chemical resin fluids separately to the resin injection adaptor 20. Once the first and second chemical resin fluids enter the resin injection adaptor 20, the chemicals start to mix within the mixing chamber 31 and then enter the drill shaft 21 via the fluid injection port 29. The pumping system 33 preferably permits different first and second chemical resin fluid flow rates to be provided to the resin injector adaptor 20, with precise differential control, to allow different mixes for different anchoring conditions.

The resin injection apparatus 19 may be retrofitted to an existing drilling apparatus, or it may be incorporated into a drilling apparatus during manufacture.

A preferred method of resin injection according to the present invention, which is typically used in connection with a drilling apparatus, here in the form of a drill rig 10, will now be described in detail.

The preferred method of injecting resin for use in connection with a drill rig 10 for installing ground anchors 60 comprises the step of providing a resin injector adaptor 20 adapted to be connected in fluid communication with the hollow drill shaft 21 of the drill rig 10. It then comprises the further step of injecting one or more chemical resin fluids via the resin injector adaptor 20 into the hollow drill shaft 21 of the drill rig 10 such that the chemical resin fluids are transferred to a hole drilled in a ground/rock strata.

Preferably, the step of injecting involves using the pump system 33 to pump a first chemical resin fluid from the fluid container 34, and a second chemical resin fluid from the fluid container 36 separately to the resin injector adaptor 20, such that the first and second chemical resin fluids are simultaneously injected into the drill shaft 21.

Advantageously the method further comprises the step of injecting a flushing medium into the resin injector adaptor 20 and the drill shaft 21 such that the flushing medium flushes the resin injection adaptor 20 and the drill shaft 21 of any residual chemical resin fluids.

Typically when a ground anchor 60 is to be installed into ground/rock strata, such as a mine roof, a hole is drilled into the rock strata by the rock drill 22. The rock drill 22 is preferably mounted on a first feed component 16 of the drill rig 10. A ground anchor 60 is provided on the second feed component 18 of the drill rig 10.

Once a hole has been drilled into the rock strata and cleaned, the drill bit 14 is returned to the base of the hole. The drill rig preferably further comprises a start button 12 on the operator's platform of the drill rig 10, which is switched ON to activate the control system 44. The control system 44 controls the flow of a first chemical resin fluid and a second chemical resin fluid, for example resin and resin catalyst from pumps 40 and 42 and the extraction speed of the rock drill 22. The pumps 40 and 42 deliver the first chemical resin fluid and the second chemical resin fluid separately to the resin injection adaptor 20 where once the chemicals enter the resin injection adaptor 20, the chemicals start to mix. The mixing process continues until all the chemicals (mixed resin and resin catalyst) have exited the drill bit 14 via the drill shaft 21. The drill shaft 21 is then withdrawn from the hole.

Once the control system 44 detects that the resin injection process is finished, the control system 44 engages automatic flushing/cleaning of the resin injection adaptor 20, drill shaft 21 and drill bit 14. The resin injection adaptor 20 check valves 46, 48 and 50 substantially limit cross contamination between the chemical resin fluids and flushing medium. These check valves 46, 48 and 50 are preferably cleaned during the automatic flushing process.

The ground anchor 60 provided on the second feed component 18 is then positioned into the resin filled hole for installation. In a preferred embodiment, the rock drill 22 rotation is engaged for added mixing of the chemicals whilst the operator of the drill rig 10 feeds the ground anchor 60 into the hole. Once the chemical resin fluids are set solid and the rotation stalls on the rock drill 22, the ground anchor 60 has been successfully installed.

FIGS. 6 to 9 illustrate a second embodiment of a fluid injector 51 employed in the fluid injection apparatus according to the present invention. The fluid injector 51 comprises a rotatable engaging means 52 for rotatably engaging a drill shaft 21 of a drilling apparatus. The rotatable engaging means 52 of this embodiment comprises first and second sealed bearings 53 and 54 which provide a fluid-tight seal about the outer surface of the coupling 27 which couples the drill shaft 21 and the interior of the rotatable engaging means 52. The rotatable engaging means 52 further comprises an outer housing 55 enclosing a mixing chamber 56. Mixing chamber 56 is in fluid communication with a fluid injection port 57 (see FIG. 9) provided in the wall of the coupling 27 in the region enclosed within the rotatable engaging means 52 of the fluid injector 51.

Figure 8:
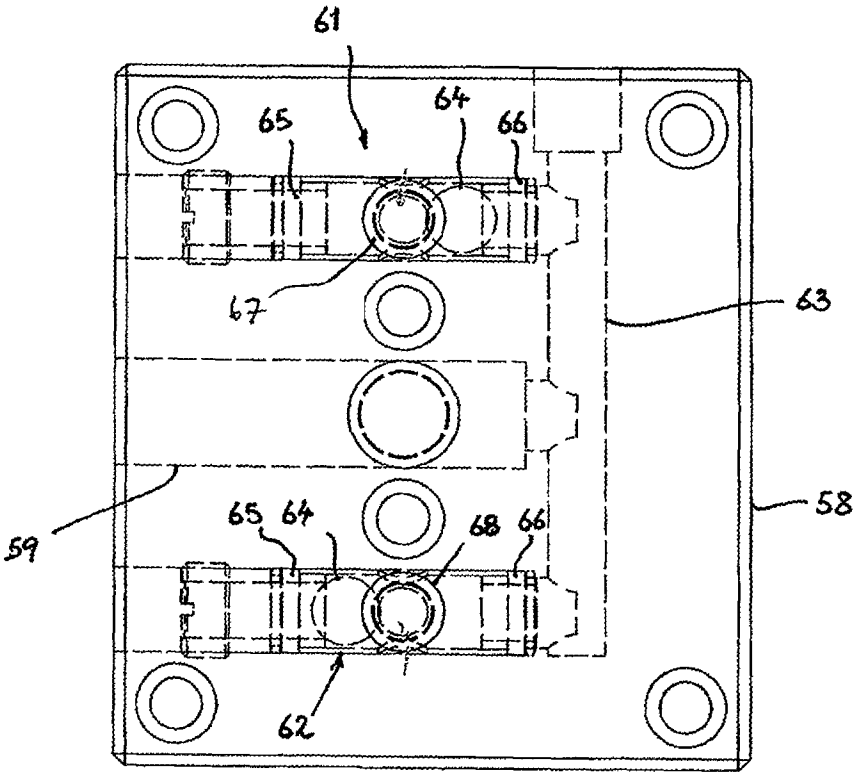
FIG. 8 is a partially transparent plan view of a valve housing employed in the fluid injector of FIG. 6B; and, FIG. 9 is a partially transparent perspective view of the fluid injector of FIG. 6B.
Figure 9:
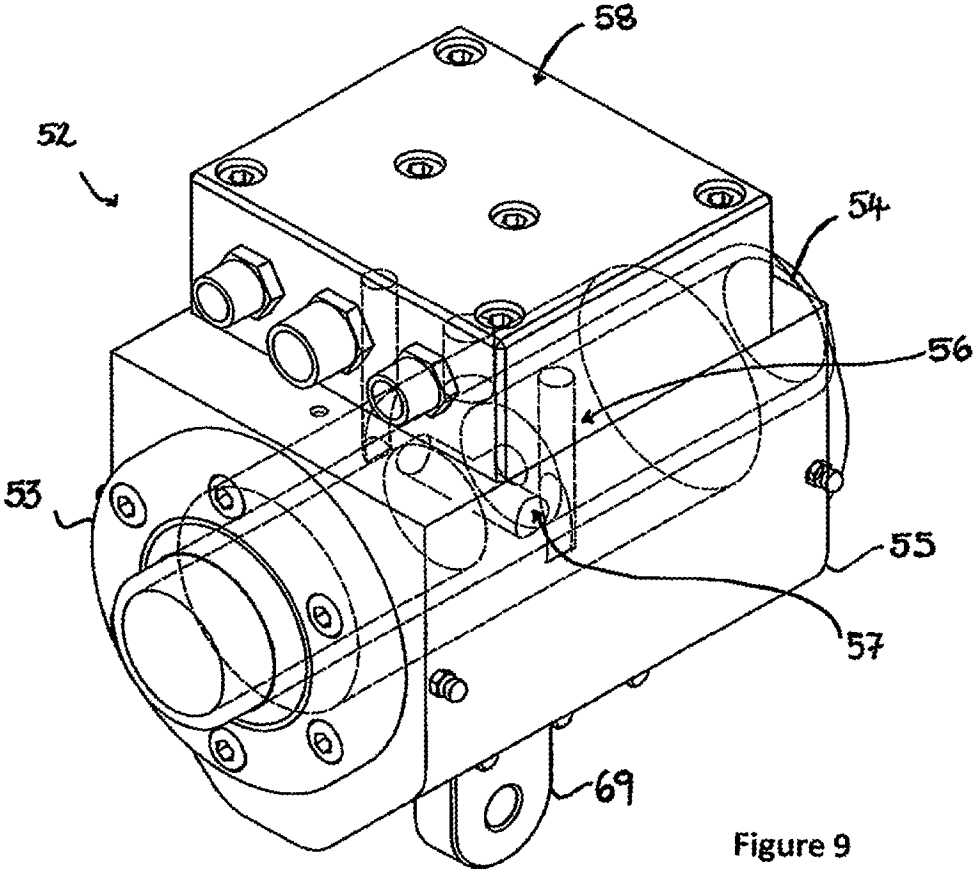

The fluid injector 51 further comprises a valve manifold 58 which is provided on a wall of the outer housing 55 of the rotatable engaging means 52, as can be seen most clearly in FIG. 8. The valve manifold 58 comprises a plurality of valves for controlling the flow of fluids into the mixing chamber 56 of the rotatable engaging means 52. In this embodiment a flushing fluid inlet 59 and two shuttle valves 61 and 62 are provided in the valve manifold 58. The flushing fluid inlet 59 is for pumping a flushing fluid such as water through the valve manifold 58, mixing chamber 56 and the drill pipe 21. As shown in FIG. 8, the flushing fluid inlet 59 and both shuttle valves have cavities that are in fluid communication with a common connecting cavity 63 provided in the valve manifold 58.

The shuttle valves 61 and 62 each comprise a shuttle ball 64 and first and second ball seats 65 and 66 which are located at each end respectively of the shuttle valve cavities. A first inlet aperture 67 is provided in a wall of the cavity of the first shuttle valve 61, intermediate the respective first and second ball seats and passes into the mixing chamber 56 below. A second inlet aperture 68 is provided in a wall of the cavity of the second shuttle valve 62, intermediate the respective first and second ball seats and also passes into the mixing chamber 56 below. The shuttle balls 64 are free to move within the respective shuttle valve cavities between the first and second ball seats 65 and 66.

In FIG. 8, the shuttle ball 64 of the second shuttle valve 62 is seated on the first valve seat 65. This is the position it would assume if flushing fluid is pumped into the common connecting cavity 63 via the flushing fluid inlet 59. It will be appreciated that the flushing fluid can thus pass through the first shuttle valve cavity and into the mixing chamber 56 below through the second inlet aperture 68.

On the other hand, the shuttle ball 64 of the first shuttle valve 61 is shown seated against the second valve seat 66 at the other end of the shuttle valve cavity. This is the position it would assume if a fluid is pumped into the first shuttle valve 61 through the first valve seat 65. In this position the shuttle ball 64 blocks off the flow of fluid into the common connecting cavity 63, and allows the fluid to enter the mixing chamber 56 via the inlet aperture 67.

The first shuttle valve 61 controls the flow of a first chemical resin fluid, for example a resin, into the mixing chamber 56 through the first inlet aperture 67. The second shuttle valve 63 controls the flow of a second chemical resin fluid, for example a resin catalyst, into the mixing chamber 56 through the first inlet aperture 67. Connecting hoses, (not shown) for transferring chemical resin fluids and flushing fluid from the fluid containers of a fluid pumping system, are connected to each of the shuttle valves 61 and 62 and flushing fluid inlet 59.

The configuration of the shuttle valves 61 and 62 with the flushing fluid inlet 59 and common connecting cavity 63 ensures that the two types of chemical resin fluid cannot ever mix prior to entry into the mixing chamber, but provide a way of flushing the valve manifold and mixing chamber with a single flushing fluid inlet. Flushing can be done with all the connecting hoses still connected to the valve manifold 58, as the shuttle balls will stop the backflow of flushing fluid into the connecting hoses of the shuttle valves 61 and 62.

A locking bracket 69 (see FIG. 9) is provided on the outer housing 55 of the rotatable engaging means 52 for securing the fluid injector 51 and preventing it from rotating with the drill shaft 21 and coupling 27. A locking bar 24 (not shown), similar that employed in the first embodiment, is connected to the locking bracket 69.

Now that preferred embodiments of the invention have been described in detail, it will be apparent that the described embodiment provides a number of advantages over the prior art, including the following:

i. The system provides a generally fast and efficient application of resin to the base of a hole through the drilling rigs normal drilling components i.e. the rock drill and drill bit, and with the aid of a fluid injector, chemical pumps, a control system for the control of resin chemical pump flow, feed retraction speed and automatic flushing/cleaning. Thereby providing an efficient, effective and economic alternative to the apparatus and methods of the prior art;

ii. The resin chemical(s) are stored separately; the stability of the resin components is not readily compromised and accordingly transportation of the resin components is easier;

iii. The performance of the resulting resin product is not affected to any great extent by ineffective mixing or interference from resin component packaging;

iv. The system provides the injection of resin product to most hole sizes, thereby accommodating ground conditions, available drill bits and available ground anchors;

v. Anchor encapsulation within resin is very important to the installation process. Since the present system provides for the resin product to be pumped into the hole, the hole can be completely filled and as the anchor is installed the mass of the anchor will displace the exact required amount of resin to ensure full encapsulation of the anchor and bond the anchor to the ground/rock strata. This in turn ensures that the area becomes a safer place for personnel and equipment;

vi. The system allows the operator to drill and inject resin product without leaving the operator's work cabin;

vii. The system allows the operator to drill a hole whilst positioning the ground anchor close to the drilled hole for installation. When the hole is finished being drilled the operator may start the injection process by switching on the pump system, and the resin is then automatically pumped into the hole. When the drill bit is free of the hole, the fluid injector and rock drill is automatically cleaned, and the operator is then able to start the installation of the ground anchor. As the process is simple and easy, this gives the operator more time to install the required amount of anchors in the shortest possible time, freeing up the operator and the drill rig for other tasks.

It will be readily apparent to persons skilled in the relevant arts that various modifications and improvements may be made to the foregoing embodiments, in addition to those already described, without departing from the basic inventive concepts of the present invention. Therefore, it will be appreciated that the scope of the invention is not limited to the specific embodiments described.

The invention claimed is:

1. A resin injection apparatus for use in connection with a drilling apparatus for installing ground anchors, the injection apparatus comprising:

a fluid injector, adapted to be connected in fluid communication with a hollow drill shaft of the drilling apparatus, for injecting one or more resin fluids into the drill shaft, the fluid injector comprising a rotatable engaging means for rotatably engaging with the drill shaft whereby, in use, when a hole has been drilled in a rock strata, resin can be injected into the hole via the drill shaft prior to inserting a ground anchor, the rotatable engaging means comprising first and second sealed bearings which provide a fluid-tight seal between an outer surface of the drill shaft and an interior of the rotatable engaging means, and further comprising an outer housing enclosing a mixing chamber within the interior of the rotatable engaging means wherein, in use, the fluid injector remains stationary while the drill shaft rotates.

2. The resin injection apparatus as defined in claim 1, further comprising a coupling connecting the fluid injector and the drill shaft, and the mixing chamber is in fluid communication with a fluid injection port provided in a wall of the coupling in a region enclosed by the mixing chamber within the rotatable engaging means of the fluid injector.

3. The resin injection apparatus as defined in claim 1, wherein the rotatable engaging means is releasably connected to the drill shaft.

4. The resin injection apparatus as defined in claim 1, the fluid injector further comprises a locking means releasably attached to an outer housing of the fluid injector and releasably attached to the drilling apparatus.

5. The resin injection apparatus as defined in claim 1, wherein the fluid injector has a plurality of fluid inlet ports for injecting different fluid components of the resin into the drill shaft.

6. The resin injection apparatus as defined in claim 5, wherein the plurality of fluid inlet ports is provided in a valve manifold.

7. The resin injection apparatus as defined in claim 6, wherein the fluid inlet ports are each provided with a valve provided in the valve manifold to inhibit cross-contamination of the different fluid components of the resin.

8. The resin injection apparatus as defined in claim 7, wherein the valves provided in the valve manifold are shuttle valves.

9. The resin injection apparatus as defined in claim 5, wherein at least one additional inlet port is provided to receive a flushing medium for flushing the fluid injector and drill shaft of the resin fluid components after use.

10. The resin injection apparatus as defined in claim 5, wherein the resin injection apparatus further comprises a fluid pumping system for transferring the resin fluid components to the fluid injector.

11. The resin injection apparatus as defined in claim 10, wherein the pumping system comprises a plurality of fluid containers, each fluid container containing a respective one of the resin fluid components, and a separate pump for each container for pumping the resin fluid components from the respective containers to a corresponding fluid inlet port on the fluid injector.

12. The resin injection apparatus as defined in claim 10, wherein the resin injection apparatus further comprises an electronic control system for controlling the operation of the fluid injector and fluid pumping system.

* * * * *